US005429033A

United States Patent [19]

Gyre et al.

[11] Patent Number: 5,429,033

[45] Date of Patent: Jul. 4, 1995

[54] METHOD OF LOADING A ROUND OF AMMUNITION INTO A PIVOTING GUN CHAMBER, AND A SYSTEM IMPLEMENTING THE METHOD

[75] Inventors: Christian Gyre, Chameyrat; Daniel Vieillefond, Ladignac/Rondelle, both of France

[73] Assignee: Giat Industries, Versailles, France

[21] Appl. No.: 148,929

[22] Filed: Nov. 8, 1993

[30] Foreign Application Priority Data

Nov. 24, 1992 [FR] France ..... 92 14073

[51] Int. Cl.[6] ..... F41A 9/45

[52] U.S. Cl. ..... 89/47; 89/46; 89/33.03

[58] Field of Search ..... 89/33.03, 46, 47, 33.05

[56] References Cited

U.S. PATENT DOCUMENTS

| | | | |
|---|---|---|---|
| 638,677 | 12/1899 | Alfson | 89/33.03 |
| 4,442,753 | 4/1984 | Pouri et al. | 89/46 |
| 4,494,441 | 1/1985 | Magnuson | 89/46 |
| 4,640,182 | 2/1987 | DeHaven et al. | 89/47 |

FOREIGN PATENT DOCUMENTS

| | | |
|---|---|---|
| 2200498 | 4/1974 | France . |
| 2257887 | 8/1975 | France . |
| 3427875 | 4/1992 | Germany . |

*Primary Examiner*—Stephen M. Johnson

*Attorney, Agent, or Firm*—Bell, Seltzer, Park & Gibson

[57] ABSTRACT

The invention relates to a method and to a system for loading a round of ammunition into a pivoting chamber of a gun, in particular a gun of small or medium caliber, the chamber pivoting in reciprocating motion between an open position and a closed position. A first device takes charge of a round of ammunition in a feed station to position it axially on the axis of the chamber when the chamber is in its open position, and to pivot the round while synchronously guiding it with the pivoting motion of the chamber, and a second device loads the round into the chamber, by bearing against the cap of the round so as to push it progressively into the chamber during the pivoting motion of the chamber. Both the first device for taking charge of a round of ammunition, and the second device for loading it into the chamber are controlled by the pivoting motion of the chamber.

11 Claims, 6 Drawing Sheets

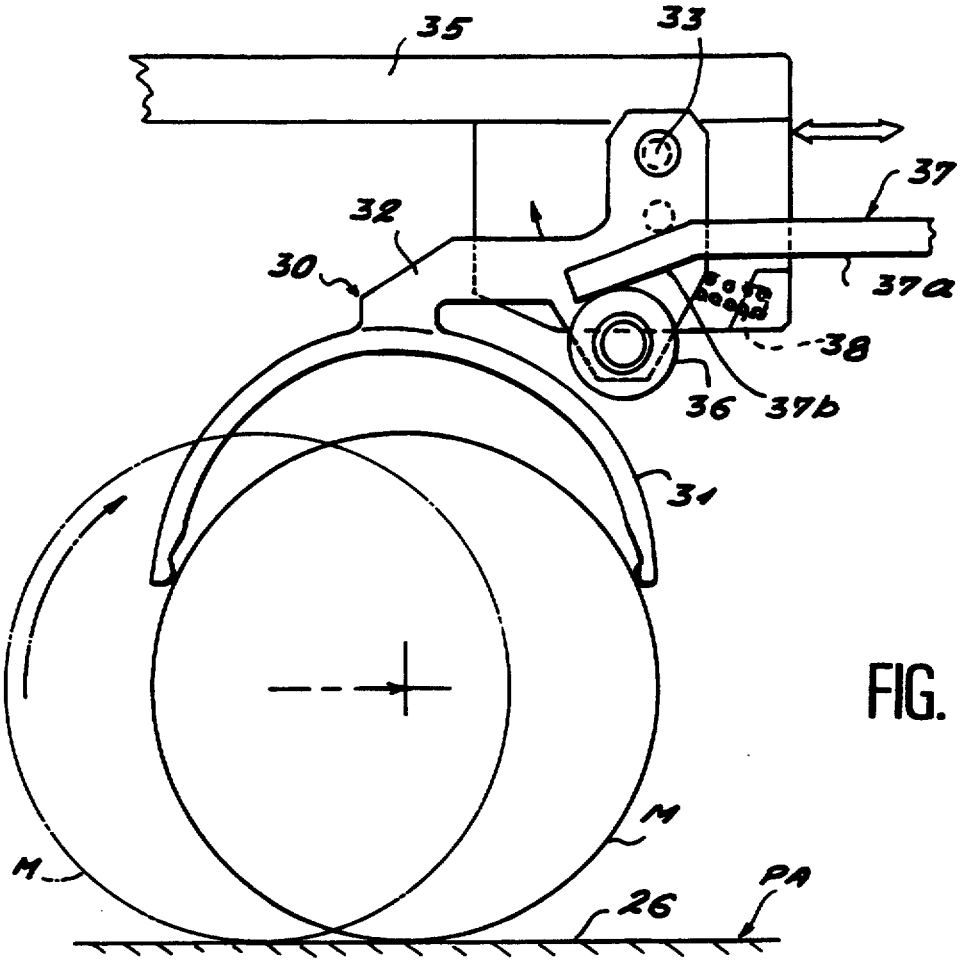
FIG. 5
FIG. 6
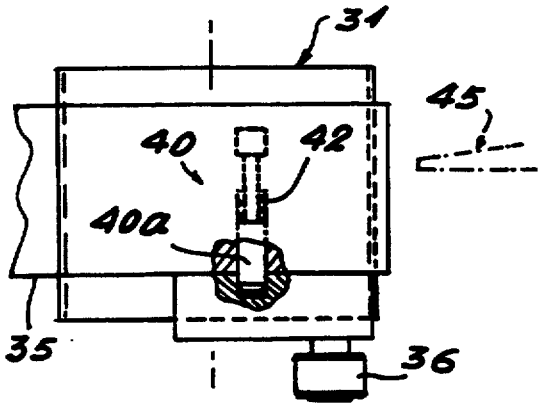
FIG. 7
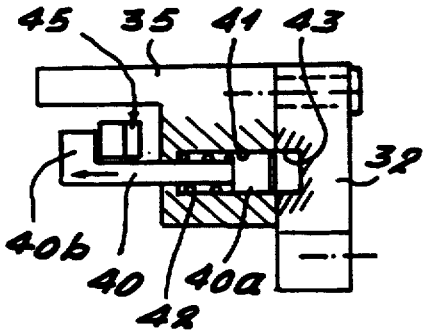

METHOD OF LOADING A ROUND OF AMMUNITION INTO A PIVOTING GUN CHAMBER, AND A SYSTEM IMPLEMENTING THE METHOD

FIELD OF THE INVENTION

The present invention relates to a method of loading a round of ammunition into a chamber of a gun, by pivoting the chamber in reciprocating manner between an open position and a closed position. The method comprises positioning a round of ammunition in a feed station thus causing it to be axially aligned with the chamber when the chamber is in the open position; and loading the round into the chamber by simultaneously pushing the round into the chamber and pivoting in synchronism with the pivoting motion of the chamber as it closes.

BACKGROUND OF THE INVENTION

In general, in known loading systems that include a pivoting chamber, a round of ammunition is inserted when the chamber is in the open position. Once the round has been inserted, the chamber pivots towards its closed position.

OBJECTS AND SUMMARY OF THE INVENTION

The object of the invention is to increase the firing rate of a pivoting chamber gun, i.e. to reduce the time required for loading a round during an opening and closing cycle of the chamber.

To this end, the invention provides a method of the above-specified type wherein the functions of taking charge of the round of ammunition and of loading it are performed during the opening and closing motions of the chamber.

Preferably, the functions of taking charge of a round of ammunition and of loading it are performed while the chamber is passing from its open position to its closed position.

The loading method may be of the type that also consists in performing an extraction function of extracting a cartridge case present in the chamber during the operation of loading a round, said extraction function also being performed while the chamber passes from its open position to its closed position.

The above-mentioned functions may be controlled by the pivoting motion of the chamber.

The invention also provides a system for implementing the above-specified method of loading a round of ammunition into a pivoting chamber of a gun, in which the gun comprises an oscillating mass hinged about a substantially horizontal axis in a support frame, and a recoil mass including, in particular, a gun barrel, the pivoting chamber, and a sleeve connected to the barrel and in which the chamber is received, wherein the loading system comprises:

- a device for taking charge of a round of ammunition in a feed station, for positioning it axially on the axis of the chamber when the chamber is in its open position, and for causing the round to pivot synchronously with the pivoting motion of the chamber towards its closed position, so as to keep the round in axial alignment with the chamber; and
- a device for loading the round into the chamber, which device bears against the cap of the round to push it progressively into the chamber during the pivoting motion of the chamber towards its closed position;
- the means for taking charge of the ammunition and for loading it being controlled by the pivoting motion of the chamber as driven by a drive member.

The device for taking charge of a round of ammunition may comprise a pivoting device for holding and guiding a round that is mounted towards the end of a first lever secured to the chamber, and that is constituted by an arcuate yoke secured to a support that is hinged to pivot on the first lever and that is movable between a raised position and a lowered position in which the yoke bears against the round during the closure motion of the chamber.

In a particular embodiment of the invention, the support of the yoke carries a wheel associated with a running path that forms a guide ramp for forcing the support of the yoke to pivot by acting against a return spring, and for lowering the yoke into an active position when the chamber reaches its open position, and a retractable locking peg is designed to lock the yoke in its active position during the closure motion of the chamber.

The loading device may include a second lever that is pivotally hinged towards one end about an axis secured to the oscillating mass of the gun and whose other end is designed to bear against the cap of the round, the second lever being connected in hinged manner by a link device to a fixed point that is secured to the chamber and that is situated on the pivot axis thereof.

In an embodiment of the invention, the above-mentioned link device comprises a telescopic arm that is kept in its retracted position by a locking device while the round is being loaded into the chamber, and that extends progressively towards the end of the chamber-closing motion without entraining the second loading lever.

The loading system may also include a cartridge case extraction device which is supported by a third lever secured to the chamber, the extraction device performing the function of guiding the case as it is extracted from the chamber while a round is being loaded.

In a particular embodiment of the invention, the third extraction lever bears against the round to cause it to pivot towards an ejection station where the round is positioned generally parallel to the axis of the barrel.

Thus, according to the invention, the dead time that was previously used for loading a round while the chamber stays in its open position is eliminated, thereby making it possible to increase the firing rate of the gun.

BRIEF DESCRIPTION OF THE DRAWINGS

Other advantages, characteristics, and details of the invention appear from the following explanatory description made with reference to the accompanying drawings that are given purely by way of example, and in which:

FIG. 5 is a diagrammatic end view of a device for holding and guiding a round of ammunition;

FIG. 6 is a diagrammatic and fragmentary plan view of FIG. 5;

FIG. 7 is a detail view of the locking peg shown in FIG. 6;

MORE DETAILED DESCRIPTION

The system for loading a round of ammunition M into a pivoting chamber 1 of a gun is shown overall in FIGS. 1 to 4. In general, the gun includes an oscillating mass MO hinged about a substantially horizontal axis X-X that is supported by a support frame shown generally at 4, and a recoil mass MR that forms a portion of the oscillating mass MO but that is movable relative thereto during the recoil motion of the gun after a round has been fired.

The recoil coil MR includes, in particular, the chamber 1 supported in pivotal manner by a sleeve 2 that receives the rear end of the gun barrel 3.

Figure 4:
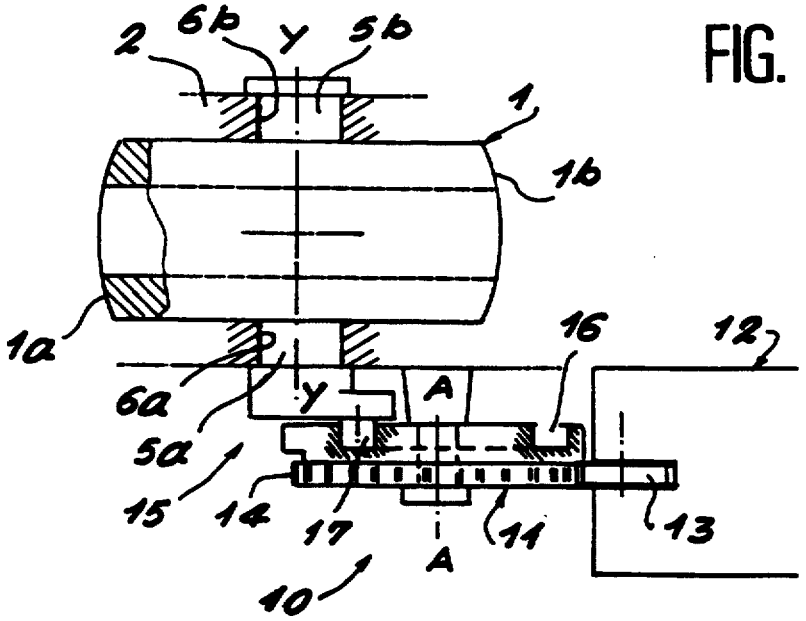
FIG. 4 is a diagrammatic view for showing the pivot control device of the chamber.

As shown in FIG. 4, the chamber 1 is constituted by an elongate hollow cylindrical body whose front and rear end surfaces 1*a* and 1*b* respectively are each spherically convex in shape. The chamber 1 is received in the sleeve 2 and it is pivotally mounted about a transverse median axis Y-Y passing through the center of the chamber 1 and orthogonal to the trunnion or elevation axis X-X of the gun. The pivot axis Y-Y of the chamber 1 is implemented in the form of two stub axles 5*a* and 5*b* in axial alignment that are rotatably supported by two bearings 6*a* and 6*b* provided in the sleeve, which sleeve 2 includes lateral openings (not shown) to enable the chamber 1 to swivel angularly.

Still with reference to FIG. 4, the chamber 1 is driven by a device 10 to pivot with reciprocating motion between an open or loading position (FIG. 1) and a closed or firing position (FIG. 2) in which the chamber 1 is in axial alignment with the gun barrel 3. The two positions of the chamber are angularly offset by an angle of about 90°.

In the example considered herein, the drive device 10 for the chamber 1 comprises a cam 11 in the form of a disk mounted to rotate about an axis A-A parallel to the pivot axis Y-Y of the chamber 1 and supported by the sleeve 2 while being offset at a distance therefrom. The cam 11 is rotated by a drive member 12 such as a motor and gear box unit, whose outlet shaft is coupled to gears represented by a single gear wheel 13 that meshes with teeth 14 provided on the peripheral edge of the cam-forming disk 11.

A mechanical link device 15 transforms the rotary motion of the cam 11 into reciprocating pivoting motion of the chamber 1. This link device 15 is constituted, for example, by a groove 16 provided on the face of the cam 11 that is adjacent to the sleeve 2, and by a cam-follower wheel 17 that is received in the groove 16. The wheel 17 is mounted free to rotate at the end of an arm 18 that laterally extends the pivot stub axle 5*a* of the chamber 1. The groove 16 is subdivided into at least four successive sectors, for example, having different radii of curvature which are followed by the wheel 17 and which, during one complete rotation of the cam 11, respectively define the closed position of the chamber 1, transition of the chamber 1 towards its open position, the open position of the chamber 1, and transition of the chamber 1 back towards its closed position.

Figure 1:
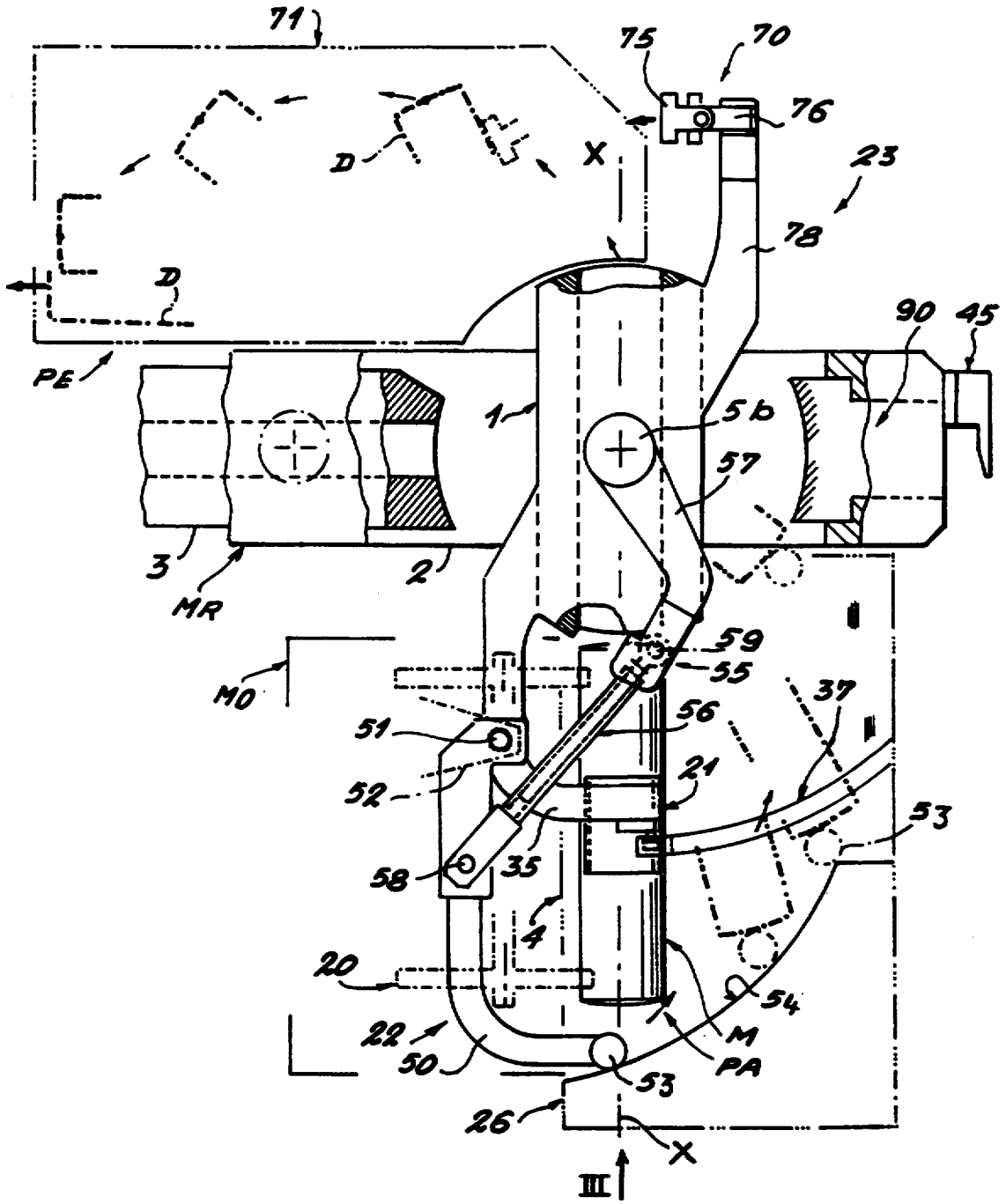
FIG. 1 is a diagrammatic plan view of the loading system of the invention, the pivoting chamber being shown in its open position.
Figure 2:
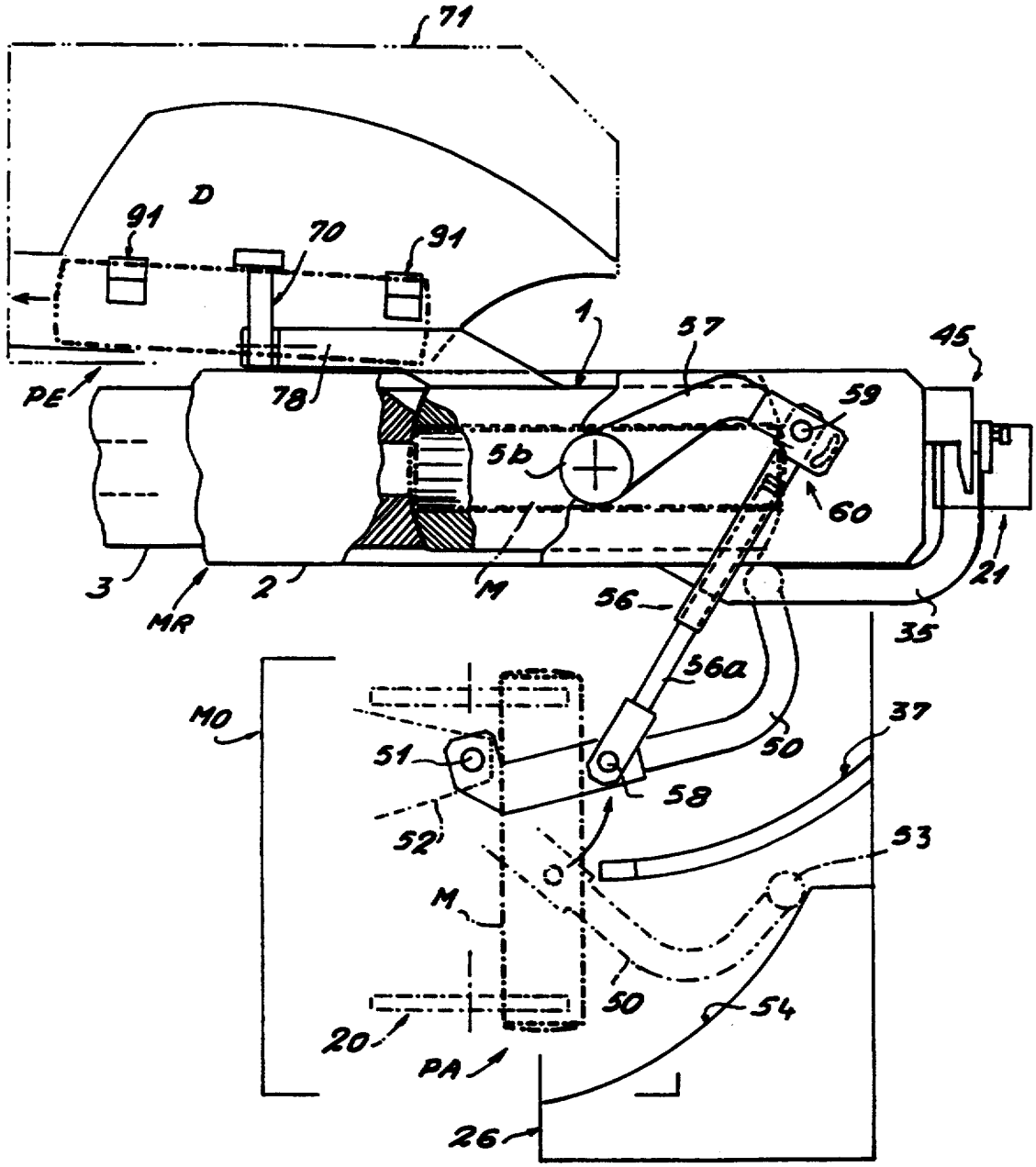
FIG. 2 is a view similar to FIG. 1, the pivoting chamber being shown in its closed position.
Figure 3:
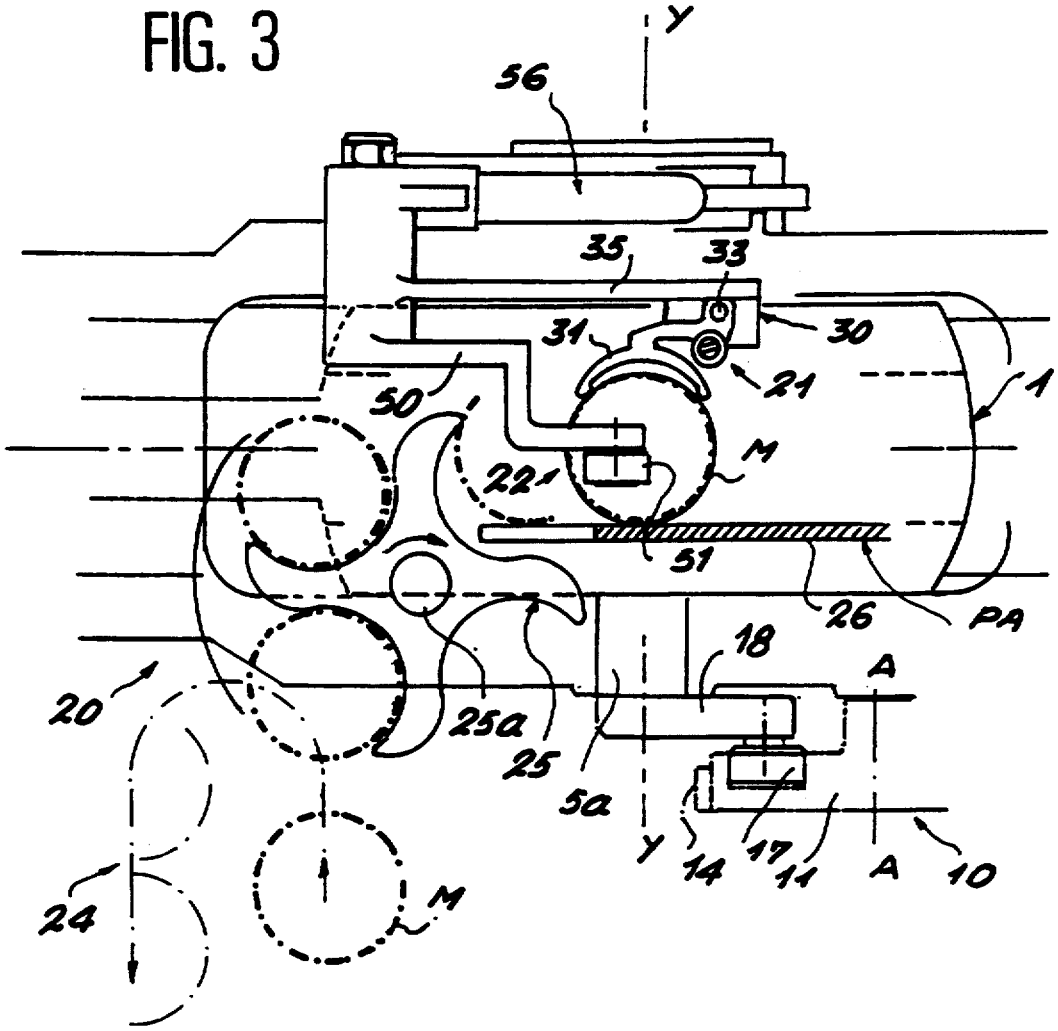
FIG. 3 is a fragmentary view as seen on arrow III of FIG. 1.

With reference more particularly to FIGS. 1 to 3, the system for loading a round of ammunition M comprises, in particular:

- a feed device 20 for feeding rounds of ammunition M;
- a device 21 for taking hold of a round M taken from the feed device 20 to keep it in axial alignment on the axis of the chamber 1 when in its open position, and to cause the round to pivot synchronously with the pivoting motion of the chamber 1 towards its closed position;
- a device 22 for loading the round of ammunition M into the chamber 1 during the closing motion of the chamber, which device bears against the cap of the round of ammunition M so as to push it progressively into the chamber 1; and
- a device 23 for extracting a cartridge case D after a round of ammunition M has been fired and during the closure motion of the chamber 1.

These various devices are now described in detail with reference to a particular embodiment of the invention.

With reference to FIG. 3, the feed device 20 comprises a magazine 24 in which rounds of ammunition M are stored, and a star-shaped shaft 25 which rotates so as to extract rounds of ammunition M one by one from the magazine 24 in conventional manner. The star shaft 25 extends parallel to the axis of the chamber 1 when the chamber is in its open position. The star shaft 25 may be rotated, for example, by the above-mentioned drive member 12.

The feed device includes a feed station PA that is generally situated level with the axis of rotation 25*a* of the star shaft 25 and that is defined by a substantially horizontal support plate 26 onto which the star shaft 25 dumps the rounds of ammunition M under gravity. The plate 26 is secured to the oscillating mass MO of the gun.

With reference more particularly to FIG. 5, the device 21 for taking hold of a round of ammunition M resting on the plate 26 of the feed station PA comprises a pivoting device 30 for holding and guiding which is designed to bear against the round of ammunition M so as to position it axially on the axis of the chamber 1 when the chamber is in its open position, and subsequently to guide it and cause it to pivot synchronously with the pivoting motion of the chamber towards its closed position.

As shown in FIG. 5, the device 30 is constituted by an arcuate yoke 31 secured to a support 32 that is mounted about a hinge axis 33 which is supported towards the end of a first lever 35 secured to the chamber 1 (FIGS. 1 and 2). The first lever 35 extends beyond the rear end portion 1*b* of the chamber 1. A wheel 36 carried by the support 32 for the yoke 31 is designed to bear against a cam-forming path defined by a guide ramp 37 situated above the plate 26 and separated therefrom by a distance greater than the outside diameter of a round of ammunition M. The guide ramp 37 has a plane portion 37*a* parallel to the pivot plane of the chamber 1, and a sloping portion 37*b*. A return spring 38 urges the yoke 31 towards its raised position, and a retractable locking peg 40 prevents the support 32 from pivoting relative to the first lever 35 so as to keep the yoke 31 bearing against a round of ammunition M (position shown in FIG. 5) so long as said round has not been fully inserted into the chamber 1 during the closure motion of the chamber 1.

As can be seen in FIGS. 6 and 7, the peg 40 passes through an opening 41 of the first lever 35 so as to have an end 40*a* that engages under urging from a return spring 42 in a blind hole 43 of the support 32 of the yoke 31 when the chamber 1 has reached its open position.

The peg 40 includes a lateral rim 40*b* towards its other end that is designed to co-operate with a stationary cam 45 (FIGS. 1, 2, and 6) supported by the rear portion of the sleeve 2 for raising the peg 40 against the return force exerted by the spring 42. The support 32 of the yoke 31 can then pivot about its hinge axis 33 supported by the first lever 35 under urging from the return spring 38, thereby entraining the yoke 31 towards its raised position.

With reference to FIGS. 1, 2, 8, and 9, the loading device 32 includes a second lever 50 that is pivotally mounted towards one end about a hinged axis 51 which is supported by a support 52 secured to the oscillating mass MO of the gun. The other end of the second lever 50 is designed to bear, e.g. by means of a wheel 53, against the cap of the round of ammunition M situated in the feed station PA so as to push it into the chamber 1. The wheel 53 is guided along a curved and stationary guide ramp 54.

The second lever 50 which pivots in a plane substantially parallel to the first lever 35 is connected in hinged manner by a link device 55 to a stationary point secured to the chamber 1 and situated on the pivot axis Y-Y thereof. This stationary point is constituted, for example, by the pivot stub axle 5*b* of the chamber 1. The link device 55 includes a telescopic arm 56 whose two elements 56*a* and 56*b* are hinged respectively to the second lever 50 about an axis 58, and to a link arm 57 which is secured to the pivot stub axle 5*b* of the chamber 1 about an axis 59. A locking device 60 is provided between the second element 56*b* of the telescopic arm 56 and the link arm 57 to maintain the two elements 56*a* and 56*b* engaged one within the other so long as a round of ammunition M has not been loaded into the chamber 1.

Figure 8:
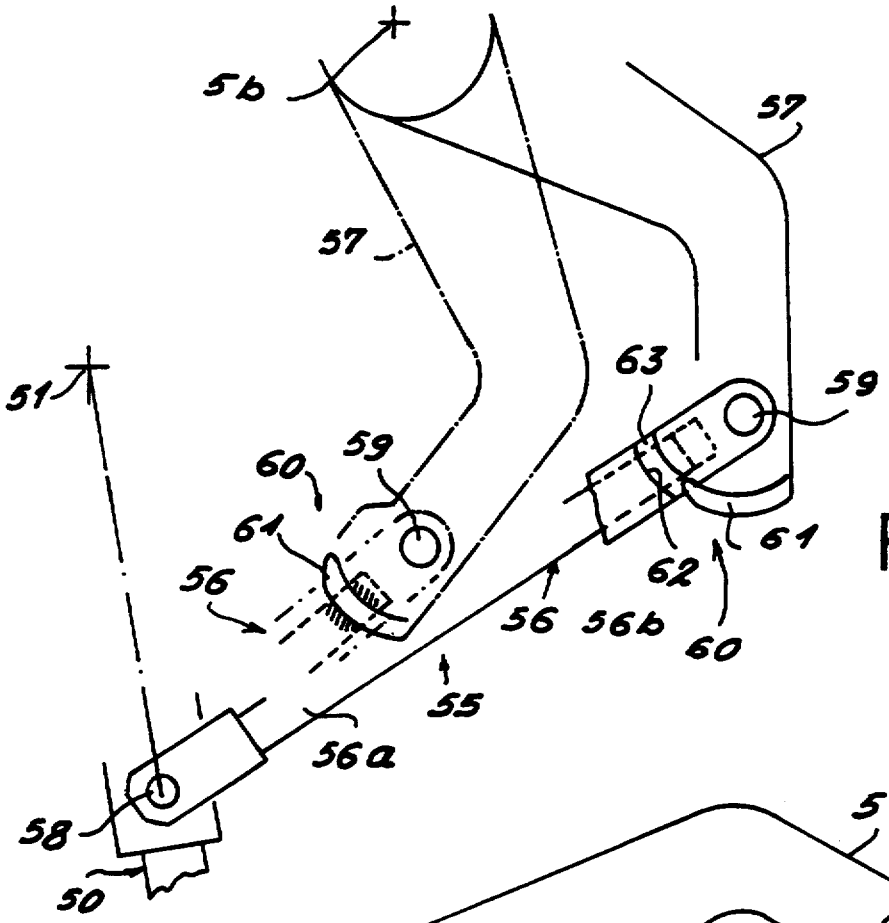
FIG. 8 is a diagrammatic view of a locking device for a telescopic arm in the retracted position, as used during the pivoting motion of the chamber.
Figure 9:
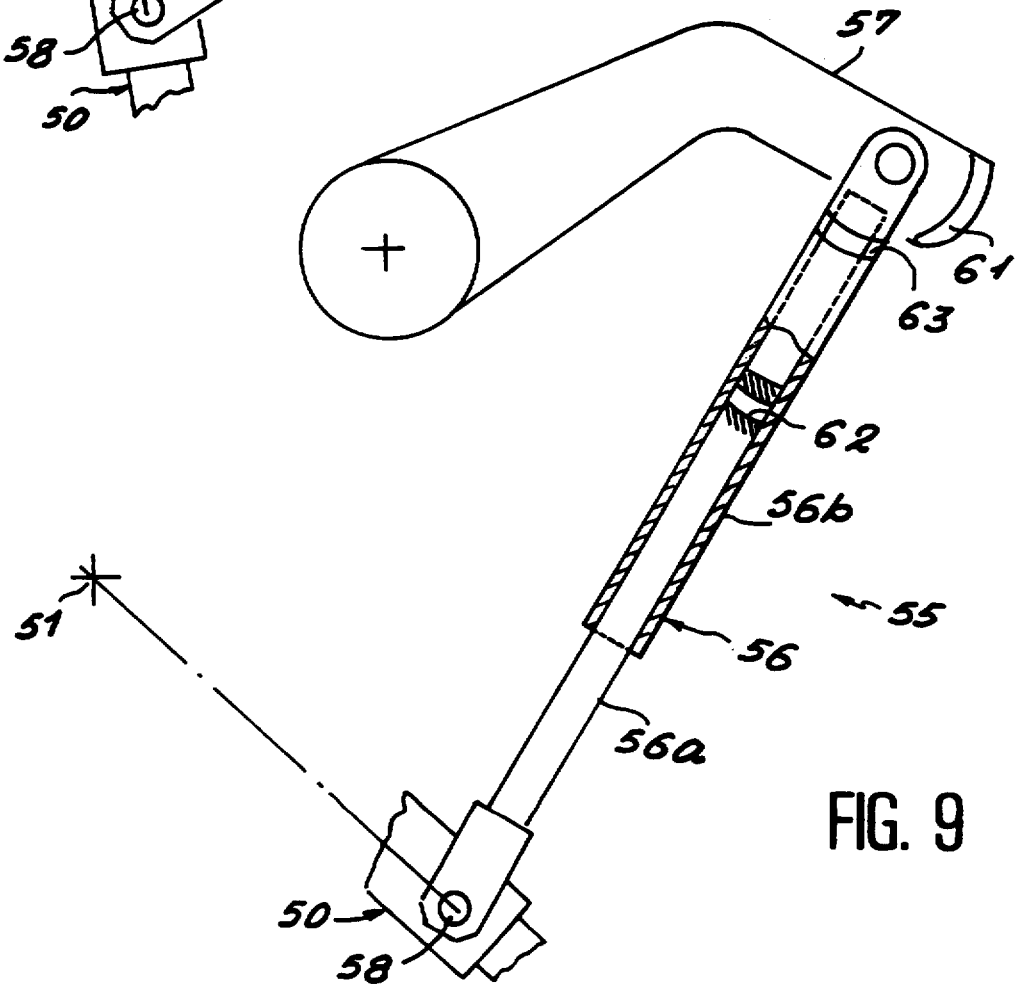
FIG. 9 is a view similar to FIG. 8, with the telescopic arm being in the extended position.

With reference more particularly to FIGS. 8 and 9, the locking device 60 is constituted by a key-forming arcuate element 61 secured to the link arm 57 and situated towards the hinge axis 59 between the arm 57 and element 56*b* of the telescopic arm 56. This key 61 is designed to have one end engaged in a lateral notch 62 of the first element 56*a* and in a lateral notch 63 of the second element 56*b* when these two notches are in alignment with each other, the key 61 disengaging progressively from these notches 62 and 63 while a round of ammunition M is being inserted in the chamber 1 because of the pivoting motion of the link arm 57 which can thus release itself from the second lever 50.

In general, the insertion motion of a new round of ammunition M through the rear end 1*b* of the chamber 1 is used in conventional manner for extracting a cartridge case D through the front end 1*a* of the chamber 1. In accordance with the invention, one such extraction device 23 as shown in FIGS. 1, 10, and 11 co-operates with a device 70 for bearing against the cartridge case D so as to facilitate conveyance thereof towards an ejection station PE.

Figure 10:
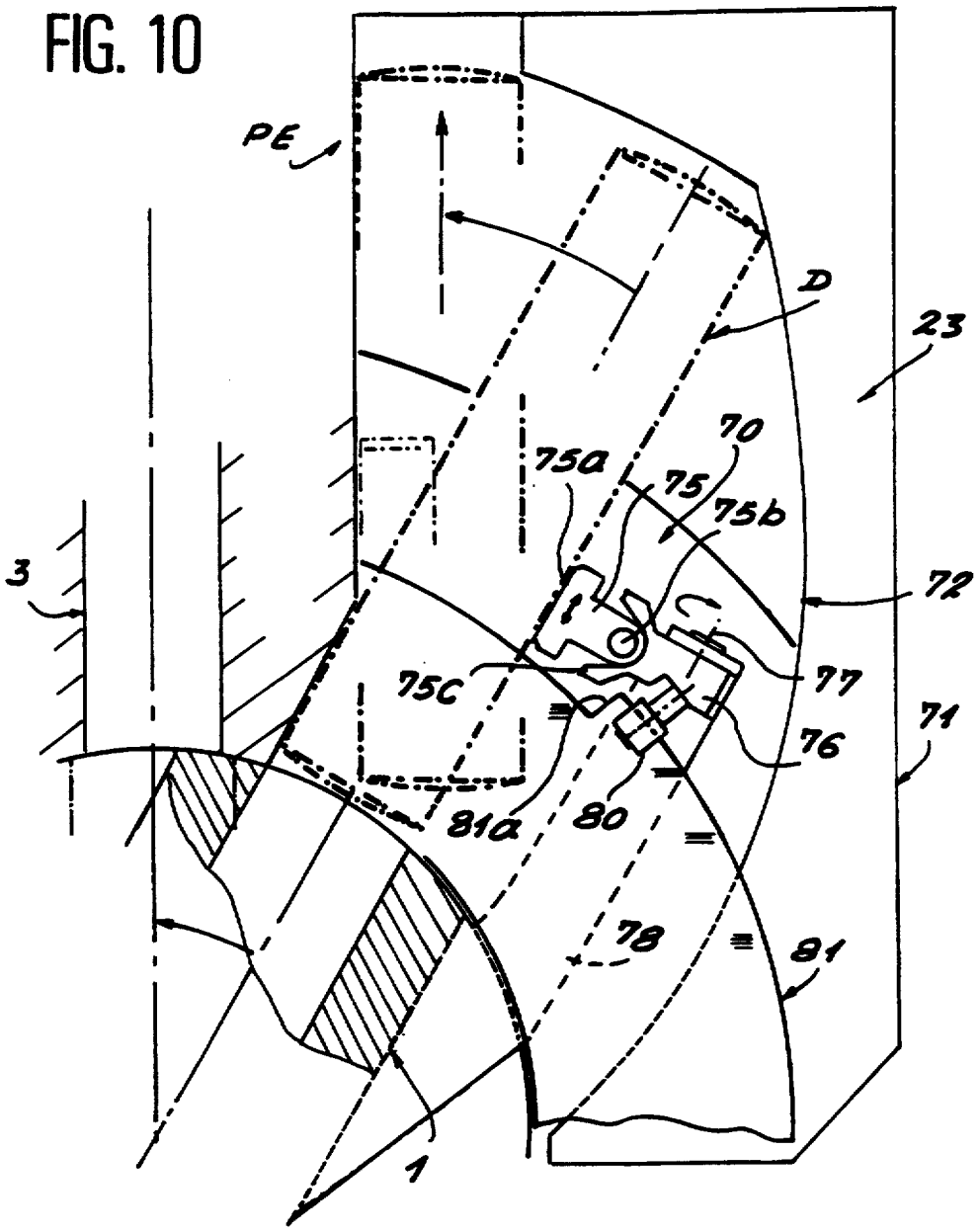
FIG. 10 is a diagrammatic plan view of the device for extracting a cartridge case from the chamber.
Figure 11:
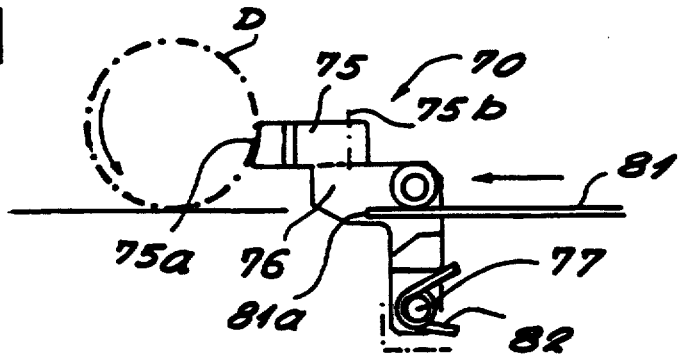
FIG. 11 is a diagrammatic view for illustrating the operation of the cartridge case extraction device shown in FIG. 10.

More precisely, with reference to FIGS. 10 and 11, the extraction device 23 includes a stationary support plate 71 that is substantially horizontal and that is secured to the oscillating mass MO of the gun. This support plate 71 and the support plate 26 of the feed station PA are situated on respective opposite sides of the gun barrel 3. The support plate 71 is fitted with a ramp 72 for guiding the cartridge case D during its pivoting motion towards an ejection station PE defined on the support plate 71 and while it is being extracted from the chamber 1.

The device 70 includes a lateral thrust arm 75 mounted on a support 76 which is hinged about an axis 77 towards the end of a third lever or "extraction" lever 78 secured to the chamber 1. This third lever 78 extends beyond the front end 1*a* of the chamber 1. The support 76 of the lateral arm 75 carries a wheel 80 for bearing against a cam-forming path defined by a guide ramp 81 that includes a break 81*a*.

A return spring 82 is designed to cause the support 76 to tilt and consequently to cause the thrust arm 75 to tilt by pivoting about the hinge axis 77 when the wheel 80 reaches the break 81*a* in the guide ramp 81 towards the end of the pivoting motion of the cartridge case D. The arm 75 whose free end 75*a* is designed to bear against the cartridge case D is hinged to its support 76 about an axis 75*b* so as to be capable of pivoting through a few degrees between two abutments 75*c* in such a manner as to enable the arm 75 automatically to position itself relative to the cartridge case D.

The operation of the above-described loading system is described below, initially without taking account of the extraction of a cartridge case D.

Assume that the chamber 1 pivots towards its open position under drive from the motor and gear box unit 12 and that it reaches an intermediate position situated slightly ahead of said position, and that a round of ammunition M is installed in the feed station PA.

In this intermediate position of the chamber 1, the yoke 31 of the device 21 for taking hold of the round of ammunition M is in its raised position, i.e. the wheel 36 is running along the plane portion 37*a* of the guide ramp 37.

At the end of the pivoting motion of the chamber 1 towards its open position, the wheel 36 runs along the sloping portion 37*b* of the guide ramp 37 thus causing the support 32 of the yoke 31 to pivot about its hinge axis 33 towards the round of ammunition M, and simultaneously compressing the return spring 38. The yoke 31 then takes up a lowered position and comes into contact with the round of ammunition M and serves to center it accurately on the axis of the chamber 1 once it has reached its open position (FIG. 1).

When the chamber 1 is in its open position, the second lever 50 or "loading" lever has its end fitted with the wheel 53 situated slightly behind the cap of the round of ammunition M, and the two elements 56*a* and 56*b* of the telescopic arm 56 are engaged one within the other and are secured to each other by the key 61 which is engaged in the two aligned notches 62 and 63 of the two elements 56*a* and 56*b*.

The closure motion of the chamber 1 by pivoting in the opposite direction about its axis Y-Y is begun without there being any need to allow the chamber 1 to pause in its open position.

While it is moving back to its closed position, the motion of the chamber 1 comprises two successive stages.

In the first or "loading" stage, the round of ammunition M is inserted in the chamber 1 while the chamber is in the process of pivoting. As it pivots, the chamber 1 causes the first lever 35 that is supporting the yoke 31 to pivot, thereby keeping the round of ammunition M in alignment with the axis of the chamber 1, and via the link device 55 it also causes the second or "loading" lever 50 to pivot so that its wheel 53 comes into abutment against the cap of the round of ammunition M.

Given that the stationary hinge axis 51 of the second lever 50 is situated between the pivot axis Y-Y of the chamber 1 and the loading wheel 53, the pivoting motion of the chamber 1 causes the distance between the axis Y-Y of the chamber 1 and the wheel 53 to reduce progressively. Under such conditions, the pivoting of the loading second lever 50 pushes the round of ammunition M into the chamber 1, causing it to engage in the rear end 1*b* of the chamber, with the yoke 31 providing no opposition to this translation displacement of the round of ammunition M.

The first or ammunition-loading stage terminates after the chamber 1 has pivoted through an angle of about 60°, i.e. at the moment when the rear end 1*b* of the chamber 1 re-engages in the sleeve 2. The round of ammunition M is then fully inserted in the chamber 1 and it is necessary to stop the action of the loading second lever 50, i.e. to prevent it rotating so that it is no longer driven by the link arm 57 that is secured to the chamber 1, with this corresponding to the second stage of the closure motion of the chamber 1. More precisely, this second stage begins when the key 61 disengages from the notches 62 and 63 of the two elements 56*a* and 56*b* of the telescopic arm 56. Thus, the telescopic arm 56 is free to extend simultaneously with the pivoting motion of the chamber 1 and thus ceases to drive the loading second lever 50 which no longer rotates.

During this second stage, the first lever 35 moves round the rear end of the sleeve 2, and when the chamber 1 is in the vicinity of its closed position, the stationary cam 45 raises the locking peg 40, thereby having the effect of raising the yoke 31 by means of the return spring 38 relaxing.

The firing stage can then be initiated by a conventional percussion device 90 located at the rear end of the sleeve 2.

Firing of the ammunition M gives rise to recoil movement of the recoil mass MR relative to the oscillating mass MO. During this recoil movement, the telescopic arm 56 lengthens so as to avoid driving the loading second lever 50 which is connected to the oscillating mass MO of the gun.

Thereafter, the pivoting chamber 1 again begins to move towards its open position, and a new loading cycle begins.

A new round of ammunition M is put into place in the feed station PA in a manner that is semi-automatic or automatic, before the chamber 1 has reached its open position.

There now follows a description of how a cartridge case D present in the chamber 1 is extracted, which cartridge case is retained in the chamber while the chamber 1 is passing from its closed position towards its open position.

In conventional manner, inserting a round of ammunition M enables a cartridge case D to be pushed out and to be extracted through the front end 1*a* of the chamber 1. The cartridge case D pivots towards the ejection station PE by bearing against the guide ramp 72 of the support plate 71. The extraction third lever 78 that pivots with the chamber 1 comes to bear against the cartridge case D via the lateral thrust arm 75 of the device 70, with this having the effect of avoiding any jamming of the cartridge case D during its pivoting motion. Towards the end of this motion, the lateral thrust arm 75 retracts to pass beneath the cartridge case D when the wheel 80 reaches the break 81*a* in the guide ramp 81. At this moment, the cartridge case D has reached the ejection station PE where it bears against two clips 91, for example, lying on an axis parallel to the gun barrel 3. Ejection proper of the cartridge case D may be performed during the recoil motion of the gun after a round has been fired.

The invention is naturally not limited to the embodiment described above. In particular, the mechanism 10 for driving the chamber 1, and the feed device 20 could be of different design without changing the principle of the invention.

We claim:

1. A method of loading a round of ammunition into a pivoting chamber of a gun, said chamber being mounted for pivoting movement in a reciprocating manner between an open position for loading and a closed position for firing said method comprising: positioning a round of ammunition in a feed station so as to cause it to be axially aligned with the axis of said chamber when the chamber is in said open position, and loading the round of ammunition into said chamber by simultaneously pushing the round of ammunition into said chamber while pivoting the round of ammunition in synchronism with the pivoting motion of said chamber toward said closed position to thus keep the round of ammunition in axial alignment with said chamber during the motion of the chamber towards said closed position.

2. A loading method according to claim 1, further comprising extracting a cartridge case present in the chamber during the motion of the chamber towards said closed position.

3. A loading method according to claim 2, wherein the step of extracting a cartridge case present in the chamber is controlled by the pivoting motion of the chamber.

4. A system for loading a round of ammunition in a pivoting chamber of a gun comprising:

a gun having an oscillating mass hinged about a substantially horizontal axis in a support frame, and a recoil mass that includes a gun barrel, a pivoting chamber mounted for movement between an open position for loading and a closed position for firing, and a sleeve connected to the gun barrel and in which the chamber is received;

a device for controlling the movement of a round of ammunition in a feed station by positioning the round axially on the axis of the chamber when the chamber is in said open position, and by causing the round to pivot synchronously with the pivoting motion of the chamber towards said closed position, so as to keep the round in said axial alignment with the chamber; and a device for loading the round into the chamber by pushing it progressively into the chamber during the pivoting motion of the chamber towards said closed position.

5. A loading system according to claim 4, wherein the device for controlling movement of a round of ammunition comprises a pivoting device for holding and guiding a round, said device being mounted towards an end of a first lever secured to the chamber, and constituted by an arcuate yoke secured to a support and hinged to pivot on the first lever, said yoke being movable between a raised position and a lowered position in which the yoke bears against the round during the motion of the chamber towards said closed position.

6. A loading system according to claim 5, wherein said yoke support carries a wheel associated with a path forming a guide ramp for forcing the support of the yoke to pivot by acting against a first return spring, and for lowering the yoke into an active position when the chamber reaches said open position, said yoke support containing a retractable locking peg designed to lock the yoke in said active position during the motion of the chamber towards said closed position.

7. A loading system according to claim 6, wherein said peg is urged by a second return spring into a locking position when said chamber is in said open position, and wherein a locking device for said peg comprises a stationary cam fixed to said sleeve and acting against said return spring to retract said peg when said chamber reaches said closed position.

8. A loading system according to claim 4, wherein said device for loading a round of ammunition into said chamber comprises a second lever hinged to pivot towards one end about an axis supported by a support secured to the oscillating mass of the gun and having an opposite end designed to press against the case of the round of ammunition, said second lever being connected in a hinged manner by means of a link device to a fixed point on the chamber situated on the pivot axis of the chamber.

9. A loading system according to claim 8, wherein the link device includes a telescopic arm that is maintained in a retracted position during the loading of the round into the chamber by a locking device, and that lengthens progressively during continued motion of the chamber towards said closed position.

10. A loading system according to claim 4, also including a device for extracting a cartridge case present in the chamber, said device being supported at an end of a third lever secured to the chamber and having a lateral thrust arm designed to bear against the cartridge case to guide it in pivoting motion towards an ejection station.

11. A loading system according to claim 10, wherein the feed station and the ejection station are situated on respective opposite sides of the gun barrel.

* * * * *